United States Patent [19]

Garabedian

[11] 4,146,006

[45] Mar. 27, 1979

[54] FUEL INJECTION SPLIT ENGINE

[76] Inventor: Arthur Garabedian, 1111 Glenview Dr., Fullerton, Calif. 92634

[21] Appl. No.: 724,146

[22] Filed: Sep. 17, 1976

[51] Int. Cl.[2] ..... F02D 17/00

[52] U.S. Cl. ..... 123/198 F; 123/32 EA

[58] Field of Search ..... 123/32 EA, 32 EH, 32 EL, 123/101, 198 F

[56] References Cited

U.S. PATENT DOCUMENTS

| | | | |
|---|---|---|---|
| 1,201,055 | 10/1916 | Jones | 123/198 F |
| 2,745,391 | 5/1956 | Winkler, Jr. | 123/198 F |
| 2,771,867 | 11/1956 | Peras | 123/198 F |
| 2,875,742 | 3/1959 | Dolza | 123/198 F |
| 3,100,478 | 8/1963 | Crooks | 123/198 F |
| 3,699,932 | 10/1972 | Aono et al. | 123/32 EA |
| 3,756,205 | 9/1973 | Frost | 123/32 EA |
| 3,765,394 | 10/1973 | Francis | 123/198 F |
| 3,896,779 | 7/1975 | Omori et al. | 123/198 F |
| 4,007,590 | 2/1977 | Nagai et al. | 123/32 EA |
| 4,064,844 | 12/1977 | Matsumoto et al. | 123/32 EA |

*Primary Examiner*—Charles J. Myhre
*Assistant Examiner*—Andrew M. Dolinar
*Attorney, Agent, or Firm*—Knobbe, Martens, Olson, Hubbard & Bear

[57] ABSTRACT

A circuit is described for a multiple cylinder engine which permits operation of all of the engine cylinders or a part thereof in response to engine loads. Different operating modes, incorporating different numbers of cylinders, are activated in a fuel injection engine in response to varying power demands. Manual switching circuits on the dashboard of the automobile permit the driver to override the automatic system and require that the engine operate in any of its operating modes. When operating in partial modes, a circuit automatically rotates the cylinder banks which are operated to assure uniform engine wear and cooling. Switches are provided on the dashboard to permit the operator to selectively skip certain engine modes in the automatic, load-responsive sequencing of engine operation.

21 Claims, 7 Drawing Figures

| | 6-CYL. | 9-CYL. |
|---|---|---|
| LINE 243 | 1 | 1 |
| LINE 247 | 0 | 0 |
| LINE 249 | 1 | 1 |
| LINE 251 | 0 | 0 |
| LINE 253 | 0 | 0 |
| LINE 255 | 0 | 0 |
| LINE 257 | 0 | 0 |

| | 6-CYL. | 9-CYL. |
|---|---|---|
| LINE 243 | 0 | 0 |
| LINE 247 | 1 | 1 |
| LINE 249 | 0 | 0 |
| LINE 251 | 1 | 1 |
| LINE 253 | 0 | 0 |
| LINE 255 | 0 | 0 |
| LINE 257 | 0 | 0 |

FUEL INJECTION SPLIT ENGINE

BACKGROUND OF THE INVENTION

The present invention relates to split engines, that is, multiple cylinder engines which are operated under varying load conditions with combustion occurring in different multiples of cylinders. More specifically, the present invention relates to a fuel injected engine where specific injectors are deactivated to permit the engine to run on less than all of its cylinders.

Numerous prior art patents show the state of the art of split multiple cylinder engines. My previous patent applications relate to a variety of such engines and are listed as follows:

| Serial No. | Filed | Title |
|---|---|---|
| 503,718 | September 6, 1974 now Pat. No. 4,019,479 | APPARATUS FOR MODIFYING AN INTERNAL COMBUSTION ENGINE |
| 629,178 | November 5, 1975 now Pat. No. 4,076,003 | SPLIT ENGINE VACUUM CONTROL FUEL METERING SYSTEM |
| 630,383 | November 10, 1975 now Pat. No. 4,070,994 | MODIFICATION FOR SELECTIVELY OPERATING A FRACTION OF MULTIPLE ROTORS OF A ROTARY ENGINE |

A satisfactory adaptation of split engine technology has not been made in regard to fuel injected engines. Specifically, the flexibility which can be provided by inhibiting individual injectors, particularly where the injectors are electrically activated, has not been appreciated in the prior art. For this reason, the prior art uniformly shows a modification of engines to require that the engine operate in specific modes depending, in most circumstances, on the vacuum within the intake manifold. These systems also uniformly show the use of all or half of the cylinders of the engine for operation. As a consequence, while the split engine concept is advantageous with regard to fuel economy and power production, split engine systems have not taken maximum advantage of the concept. Thus, for example, such engines have not included additional multiple cylinder modes of operation, nor have they provided convenient controls for a driver so that manual override of the automatic system is permitted or manual control of certain engine modes provided.

SUMMARY OF THE INVENTION

The present invention alleviates these difficulties of the prior art and is particularly adapted to automobiles including multiple cylinder engines where the engine is provided with electrically operated fuel injection valves. In such engines, the present invention permits the inhibiting of different numbers of cylinders. For example, in a twelve cylinder engine, either three cylinders or six cylinders may be inhibited while still providing balanced engine operation. This permits three different modes of engine operation: six cylinder, nine cylinder or twelve cylinder. In the control system of the present invention, the engine is operated on six cylinders at low load, nine cylinders at moderate load and twelve cylinders at heavy load. In addition, the present invention permits the manual overriding of this automatic system to skip either the six or nine cylinder operational modes in the automatic system operation or to totally override the automatic operation and demand that the engine operate on either six cylinders, nine cylinders or twelve cylinders at all times.

The present invention additionally includes electronic circuitry which varies the particular cylinders which are operated in each of the partial operational modes. This operation overcomes problems inherent in split engines, namely the overheating of the part of the engine while the remaining part of the engine remains relatively cool, or excessive wear in those cylinders which would otherwise always provide the partial engine operation.

The advantages of the present system are accomplished through the use of a vacuum switch assembly which monitors intake manifold vacuum to generate command signals for either six, nine or twelve cylinder operation. Joined with this vacuum switch assembly is a manual overriding switch assembly which provides manual control of the system and inhibits operation of the vacuum switch assembly. These two switch assemblies drive six, nine and twelve cylinder command circuits which are used to provide six, nine and twelve cylinder output drive signals. These signals are combined with the signals from a group advance network which specifies which partial groups of cylinders are to operate at a particular time in partial engine modes. The combined signals from these circuits are supplied to a group decoder circuit which, through a driver interface and injector driver circuit, operate four injector banks each having three injectors for selectively inhibiting one or two groups, the particular groups being designated by the group advance circuit. A function display circuit notifies the driver at all times of the particular mode of engine operation while a group displayed circuit notifies the driver as to the injector groups which are currently operating.

The circuit therefore provides a total interface between the driver and engine, permitting him to override the automatic system or parts of it, and notifying him at all times of the particular mode of operation of the engine and the groups of injectors which are operational.

While the present invention is described in reference to a twelve cylinder engine, it could be applied easily to an eight cylinder engine operating in eight, six or four cylinder modes, or any other multiple cylinder engine operating in three or more partial cylinder modes.

The details and advantages of the present invention are best understood through a reference to the drawings, in which.

DETAILED DESCRIPTION OF THE PREFERRED EMBODIMENT

Figures 1, 2, 7:
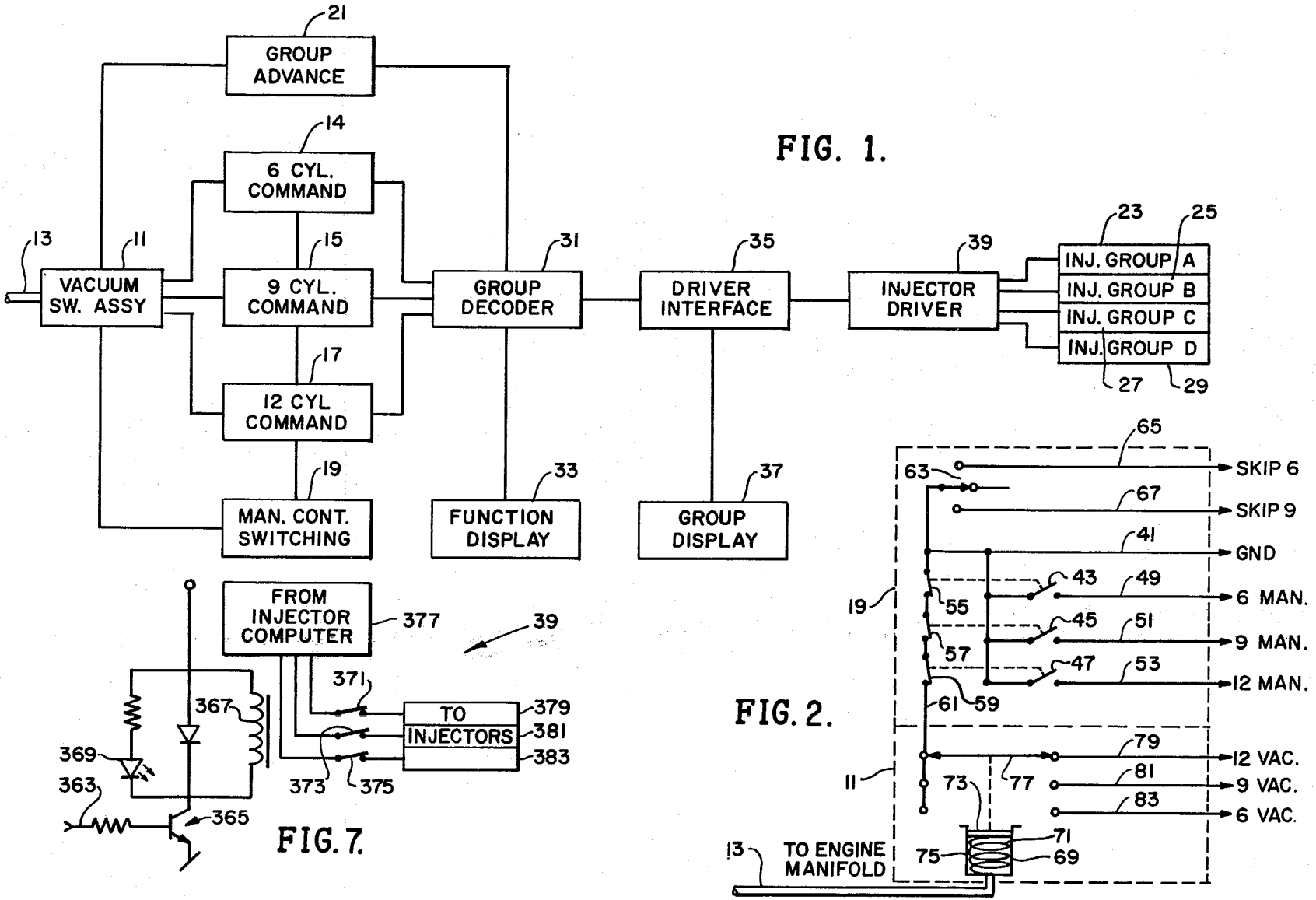
FIG. 1 is an overall block diagram schematic of the circuit of the present invention.
FIG. 2 is a detailed schematic diagram of the manual and vacuum switching assemblies of the present invention.
FIG. 7 is a detailed schematic illustration of the injector driver circuit of the present invention operating on a group of three injectors of the multiple cylinder engine.

Referring initially to FIG. 1, the overall operation of the fuel injection control utilized in the present invention for permitting fuel injection to a selected portion of the fuel injectors of the automobile engine will be described. A vacuum switch assembly 11 is connected to a vaccum line 13 which is, in turn, connected to the intake manifold of the engine. It will be understood that the vacuum in line 13 varies substantially inversely to engine demand, such that when the vacuum is relatively high, engine demand and load are relatively low, whereas, when the vacuum is relatively low, engine demand is relatively high. It would be expected, for example, during normal cruising of the automobile on level ground particularly at lower speeds, that the vacuum in the line 13 would be relatively high. During maximum acceleration or when the automobile climbs steep inclines, the vacuum in the line 13 will be relatively low. The vacuum switch assembly 11 monitors this vacuum to produce output signals to a six cylinder command circuit 14, a nine cylinder command circuit 15 and a twelve cylinder command circuit 17 to operate one of these command circuits in accordance with the vacuum level in line 13, thereby permitting injection of fuel into all or less than all of the engines cylinders. In this preferred embodiment, it will be understood that a twelve cylinder engine is modified by the present invention, and the modification permits operation of such an engine on either all twelve cylinders, on a selected group of nine cylinders or a selected group of six cylinders.

Alternatively, the automobile driver, using a manual switch console 19 located at the driver's seat of the automobile, may override the vacuum switch assembly 11 to (a) require that the automobile operate on twelve cylinders at all times; (b) require that the automobile operate on nine cylinders at all times; (c) require that the automobile operate on six cylinders at all times; (d) require that, rather than shifting from twelve cylinders to nine cylinders to six cylinders, depending upon the engine load, the nine cylinder mode be skipped or (e) that the six cylinder mode be skipped.

Since continued operation in the nine cylinder or six cylinder modes utilizing the same engine cylinders every time the mode is entered may cause uneven wear of the engine cylinders or overheating of the engine, a group advance circuit 21 is used in conjunction with the six, nine and twelve cylinder command circuits 13, 14, 17 and manual switching circuit 19 to alter the group of operating cylinders upon each subsequent operation. Thus, the twelve fuel injectors connected to the engine are broken into four groups of three injectors, 23, 25, 27 and 29. Six cylinder operation is accomplished by operating groups 23 and 25 while inhibiting operation of groups 27 and 29 or, alternatively, by operating groups 27 and 29 while inhibiting operation of groups 23 and 25. The particular pair of groups being operated each time the six cylinder command circuit 13 or manual switch circuit 19 requires six cylinder operation will depend upon the state of the group advance circuit 21.

Similarly nine cylinder operation of the twelve cylinder engine is accomplished while inhibiting operation of any one of the injector groups 23 through 29. The particular injector group which is inhibited upon entering the nine cylinder mode is determined by the group advance circuit 21.

The signals from the six, nine and twelve cylinder command circuits, 14, 15, 17 and group advance circuit 21 are combined in a group decoder circuit 31. The group decoder 31 in turn drives a function display 33 to indicate to the driver the mode (six, nine or twelve cylinder) of engine operation, and a driver interface 35 which is used to decode the output signals from the group decoder 31. The driver interface 35 drives a group display 37 which indicates to the driver, through illuminated signals, which injector gruops 23 through 29 are operating, and additionally supplies signals to an injector driver circuit 39 which is used to inhibit operation of certain of the injector groups 23 through 29.

Referring now to FIG. 2, the details of the vacuum switch assembly 11 and manual control switching assembly 19 will be described. A ground conductor 41 is connected to three normally open switches 43, 45 and 47 labelled on the switch assembly, respectively, six cylinder, nine cylinder and twelve cylinder. These switches, when individually closed, supply a ground potential on lines 49, 51 and 53, respectively labelled 6 MAN, 9 MAN and 12 MAN, which signals are used to operate the engine at all times on the number of cylinders designated. The ground bus 41 is additionally connected to three normally closed switches 55, 57 and 59 which are mechanically ganged, as shown in dotted lines, to the normally open switches 43, 45 and 47, respectively. The switches 55 through 59 are series connected so that an output is produced on a vacuum common line 61 only when none of the switches 43, 45, 47 has been actuated.

The ground bus 41 also supplies ground potential to a three position rotary switch 63 which is inoperative in the neutral position shown in FIG. 2 but which, when switched, conducts ground potential to a SKIP 6 output line 65 or a SKIP 9 output line 67. The switch 63 is utilized in the vacuum control mode to skip either the six cylinder or nine cylinder operational modes, as will be understood in more detail through the description below.

The vacuum common line 61 interconnects the manual switching assembly 19 with the vacuum switch assembly 11 and supplies a ground potential when none of the switches 43 through 47 is activated. Thus, the vacuum switching assembly 11 is operable only when none of the six, nine or twelve cylinder modes have been manually selected. The common line 61 is connected to a vacuum actuator 69 which is, in turn, connected to the vacuum line 13. The vacuum actuator typically includes a spring 71 biasing a piston 73 within a cylinder 75. When the vacuum is relatively low, the piston 73, controlled by the spring 71, will be in the position shown in FIG. 2. As the vacuum increases, however, the piston 73 will move downward, as viewed in FIG. 2, compressing the spring 71. This movement will draw the switch contact 77 to selectively interconnect the ground potential on line 61 with one of three lines 79, 81 and 83, labelled respectively 12 VAC, 9 VAC and 6 VAC. It can be seen, therefore, that when the vacuum in line 13 is at its highest level, the ground potential at line 61 will be connected with output line 83. At a somewhat lower vacuum level, the ground potential will be connected to line 81, and at a still lower vacuum level, the ground potential will be connected to the output conductor 79. The conductor 79 operates to produce a twelve cylinder command signal. Similarly, conductors 81 and 83 produce nine and six cylinder command signals.

Figure 3:
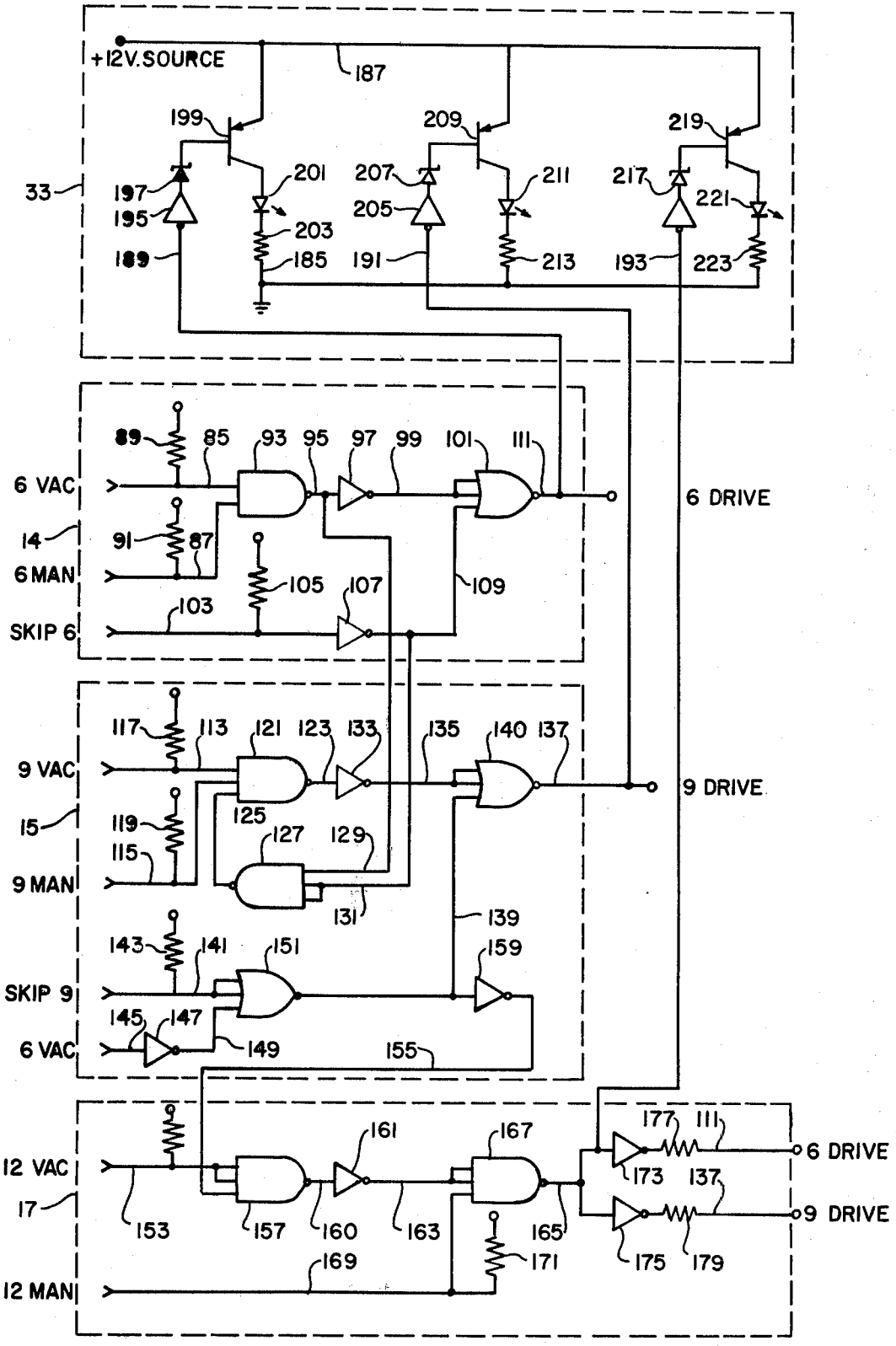
FIG. 3 is a detailed schematic illustration of the six, nine and twelve cylinder command circuits of the present invention, together with the function display circuit thereof.

The output lines from the manual switch assembly 19 and vacuum switch assembly 11 are connected to the six cylinder command 4, nine cylinder command circuit 15 and twelve cylinder command circuit 17 of FIG. 1. The details of these circuits are shown in FIG. 3. The six cylinder command circuit 14 includes a pair of input lines 85 and 87 connected to lines 83 and 49, respectively of FIG. 2, and labelled 6 VAC and 6 MAN. These lines 85, 87 are each biased to a positive potential through resistors 89 and 91, respectively, and are therefore maintained at a positive voltage level in the absence of a grounding signal from the output lines of FIG. 2. For the purpose of simplicity, throughout the remaining detailed description of this specification, ground level potential will be considered a binary 0 state whereas an elevated or positive potential will be considered a binary 1 state. Thus, the lines 85 and 87 are maintained at binary 1 unless they receive binary 0 signals from the circuit of FIG. 2, the binary 0 signal having preference over the binary 1 signal because of the biasing resistors 89 and 91.

The lines 85 and 87 are connected to a NAND gate 93 which produces a binary 0 output only if both of the inputs on lines 85 and 87 are at a binary 1 level. In all other input combinations on the lines 85 and 87, the NAND gate 93 produces a binary 1 output. Thus, in the absence of a grounding input signal on either of lines 85 or 87, a binary 1 input is presented on both of the lines 85 and 87 and the output of the NAND gate 93 is a binary 0. If either of the lines 85, 87 receives an input signal from the manual switching assembly 19 or vacuum switching assembly 11, and specifically from the switches 43 and 77, the output of the NAND gate 93 will change state to binary 1. This is an indication that six cylinder operation is ordered. The binary 1 state on line 95, the output of NAND gate 93, is inverted in an inverter 97 to produce a binary 0 state on output line 99. This line 99 forms one input to a NOR gate 101. The second input to the NOR gate 101 is generated from input line 103, labelled SKIP 6, which is connected to line 65 of FIG. 2. If the driver has indicated that the six cylinder mode is to be skipped, the line 103 will be at ground potential. Otherwise, the line 103 will be at binary 1 potential, induced by a biasing resistor 105 connected to a source of positive voltage. The signal on line 103 is inverted in the inverter 107 so that if the SKIP 6 switch 63 of FIG. 2 is not closed, the output on line 109 of inverter 107 will be at binary 0. The NOR gate 101 produces a binary 1 output on line 111 only if both of the inputs on line 99 and 109 are at binary 0. For all other input combinations, the output of the NOR gate 101 is a binary 0. Thus, for the condition where six cylinder operation is ordered by a binary 0 on line 99 and the SKIP 6 switch 63 (FIG. 2) has not been closed, a binary 0 appears at both lines 99 and 109, generating a binary 1 on line 111, indicating the need for six cylinder drive. If the SKIP 6 switch 63 (FIG. 2) has been closed, a binary 1 signal level will appear at line 109, so that line 111 will remain at binary 0, indicating that six cylinder drive is not ordered. Similarly, if both of the lines 85 and 87 are at binary 1 level, a binary 1 level will exist on line 99, resulting in a binary 0 level on line 111, indicating that six cylinder operation is not ordered.

Referring now to the nine cylinder command circuit 15 of FIG. 3, a pair of input lines 113 and 115 connect, respectively, to lines 81 and 51 of FIG. 2 and are biased to a binary 1 level by resistors 117 and 119, respectively. Thus, in the absence of binary 0 signals, the lines 113 and 115 will be combined in NAND gate 121 to produce a binary 0 level on its output line 123. When either of the lines 113 and 115 is induced with a binary 0 signal in response to the closure of switches 77 or 45, a binary 1 level will be produced at the output of the NAND gate 121.

The NAND gate 121 has an additional input line 125 connected to the output of NAND gate 127. The NAND gate 127 will produce a binary 1, permitting normal operation of NAND gate 121, in response to signals on lines 113 and 115, unless each of the input signals on lines 129 and 131 is at binary 1. This occurs when the SKIP 6 switch 63 is closed, generating a binary 1 on line 109 connected to line 131, and the vacuum switch 77 is in the six cylinder position, grounding input line 85 and producing a binary 1 at the output of the NAND gate 93. Thus, if the six cylinder mode is to be skipped, as indicated by closure of the switch 63 to ground line 65 of FIG. 2, and six cylinder operation is required by the vacuum switch 77 of FIG. 2, a pair of binary 1 signals will appear at line 129 and 131, generating a binary 0 on line 125 to initiate nine cylinder operation by producing a binary 1 at the output of the NAND gate 121. It can be seen, therefore, that nine cylinder operation will occur either when ordered by normal closure of the switches 45 or 77 of FIG. 2 in the nine cylinder position, or by closure of the switches 43 or 77 in the six cylinder position in FIG. 2, when the switch 63 of FIG. 2 is in the SKIP 6 position.

The signal on line 123 is inverted in an inverter 133 so that a binary 1 on line 123 indicating nine cylinder operation generates a binary 0 on an output line 135 from the inverter 133. This binary 0 signal on line 135 will normally produce a binary 1 on line 137, the output of NOR gate 140, indicating the ordering of nine cylinder operation for the automobile. Such a binary 1 signal on line 137 will be produced only if the second input on line 139 to the NOR gate 140 is at binary 0.

The SKIP 9 signal line 67 of FIG. 2 is connected to an input line 141 which is normally biased to a positive potential to a resistor 143. In addition, the signal from line 83 serves as an input on signal line 145 and is inverted in an inverter 147 to produce a signal on line 149. Lines 141 and 149 provide the inputs for a NOR gate 151 which in turn provides the signal on line 139. If the SKIP 9 switch 63 has been closed to ground line 67 of FIG. 2, a binary 0 signal is present on line 141. Similarly, a binary 0 signal will be present on line 149 whenever the vacuum switch 77 of FIG. 2 is in a position other than in contact with line 83, and a binary 1 signal therefore exists on line 139. This binary 1 signal will induce a binary 0 signal output from the NOR gate 140 on line 137, so that nine cylinder operation cannot be ordered. The input on line 145 is used to assure that, whenever six cylinder operation is ordered by the switch 77 of FIG. 2, such operation cannot be interrupted by placement of the switch 63 in FIG. 2 in the SKIP 9 position.

It can be seen, therefore, that nine cylinder operation is required by a binary 1 signal on the line 137 which will exist in response to a binary 0 signal on either of lines 113, 115 or 125 in the absence of a binary 0 signal on line 141. The presence of a binary 0 signal on line 141 will interrupt nine cylinder drive operation when it is otherwise ordered.

Referring now to the twelve cylinder command circuit 17 of FIG. 3, an input line 153 is combined with a signal on line 155 in a NAND gate 157. The signal on line 155 is derived by inverting the signal on line 139 in an inverter 159. If the signal on line 153 is at binary 0, in response to closure of the switch 177 of FIG. 2 to ground line 79 thereof, the output of NAND gate 157 on line 159 will be a binary 1. Similarly, if the SKIP 9 switch 63 of FIG. 2 has been closed, a binary 0 will be induced on line 155 by the inverter 159, also generating a binary 1 signal level on line 159. The line 159 will therefore order twelve cylinder engine operation if (a) twelve cylinder operation is required by the switch 77 or (b) the SKIP 9 switch 53 is closed and the vacuum switch 77 of FIG. 2 is not in the six cylinder position, as monitored on line 145 of FIG. 3. Thus, once nine cylinder operation has been ordered skipped, twelve cylinder operation will be ordered whenever nine cylinder operation would normally be required. The binary 1 signal on line 160 is inverted in an inverter 161 to produce a binary 0 signal on output line 163. This binary 0 signal will induce a binary 1 signal at the output 165 of a NAND gate 167. Similarly, closure of the switch 47 of FIG. 2 will induce a binary 0 signal on line 169 which is connected to line 53 of FIG. 2. This line 169 is normally biased to a binary 1 level through a resistor 171. If the switch 47 of FIG. 2 is closed, or if a binary 0 level is present on line 163, a binary 1 signal on line 165 will be produced and inverted in a pair of inverters 173 and 175 for application, through a pair of resistors 177 and 179, respectively, to the six drive output connector line 111 and the nine drive output connector line 137 respectively. The ordering of twelve cylinder operation produces a binary 0 at the output of both inverters 173 and 175. Inverter 173 is connected to line 111, the output of gate 101, and inverter 175 is connected to line 137, the output of gate 140, so that the ordering of twelve cylinder operation will produce a binary 0 signal on lines 137 and 111 through the resistors 177 and 179 to remove any binary 1 signal which might otherwise be present. The existence, therefore, of a binary 0 signal level on line 111 and 137 will order twelve cylinder operation of the engine.

From the preceding description it can be seen that six cylinder operation can be ordered by switches 43 and 77 (line 83) of FIG. 2. Nine cylinder operation can be ordered by switches 45 and 77 (line 81) of FIG. 2 or, alternatively, can be ordered by closure of the SKIP 6 switch 63 of FIG. 2 and simultaneous closure of switches 43 or 77 (line 83) of FIG. 2. Twelve cylinder operation can be ordered by switch 47 of FIG. 2 or closure of the switch 77 (line 79) of FIG. 2. In addition, twelve cylinder operation will occur if the SKIP 9 switch 53 grounds line 67 while, at the same time, the switch 77 of FIG. 2 is in any position other than in contact with line 83. Thus, the SKIP 6 switch 63, when in the SKIP 6 position, will force the engine to alternate between the nine and twelve cylinder modes. When the SKIP switch 63 is in the SKIP 9 position, this switch will order the engine to alternate between the six and twelve cylinder modes. When the SKIP switch 63 is in the neutral position, control of the engine modes will be directly in response to the switches 43, 45 or 47 or, if these switches are all open, will be in response to the position of the switch 77 of FIG. 2.

FIG. 3 also shows the details of the function display 33. This display is connected by line 185 to ground, by line 187 to a source of positive potential, by line 189 to the six cylinder drive line 111, by line 191 to the nine cylinder drive line 137, and by line 193 to the twelve cylinder drive line 165. Each of the lines 189, 191 and 193 will have a binary 1 signal when the output of the circuits 14, 15 and 17 indicate a six, nine or twelve cylinder operation of the engine. A binary 1 signal on the line 189 will be amplified in an amplifier 195 and applied through Zener diode 197 to the base of a switching transistor 199. The transistor 199, in the presence of a binary 1 signal on the line 189, will conduct, illuminating a light emitting diode 201 connected in series with a resistor 203 between lines 187 and 185, the light emitting diode 201 being located in the driver's compartment of the automobile and indicating to the driver that six cylinder operation of the engine us being ordered. Similarly, an amplifier 205, Zener diode 207, and transistor 209 operate to illuminate a light emitting diode 211 connected in series with a resistor 213 in response to nine cylinder operation of the automobile engine. Likewise, an amplifier 215, Zener diode 217, and transistor 219 operate to illuminate a light emitting diode 221 connected in series with a resistor 223 in the presence of a binary 1 signal on line 193 indicating that twelve cylinder operation of the engine has been ordered. The driver is therefore always apprised of the mode of operation of the automobile engine.

Figures 4, 5, 6:
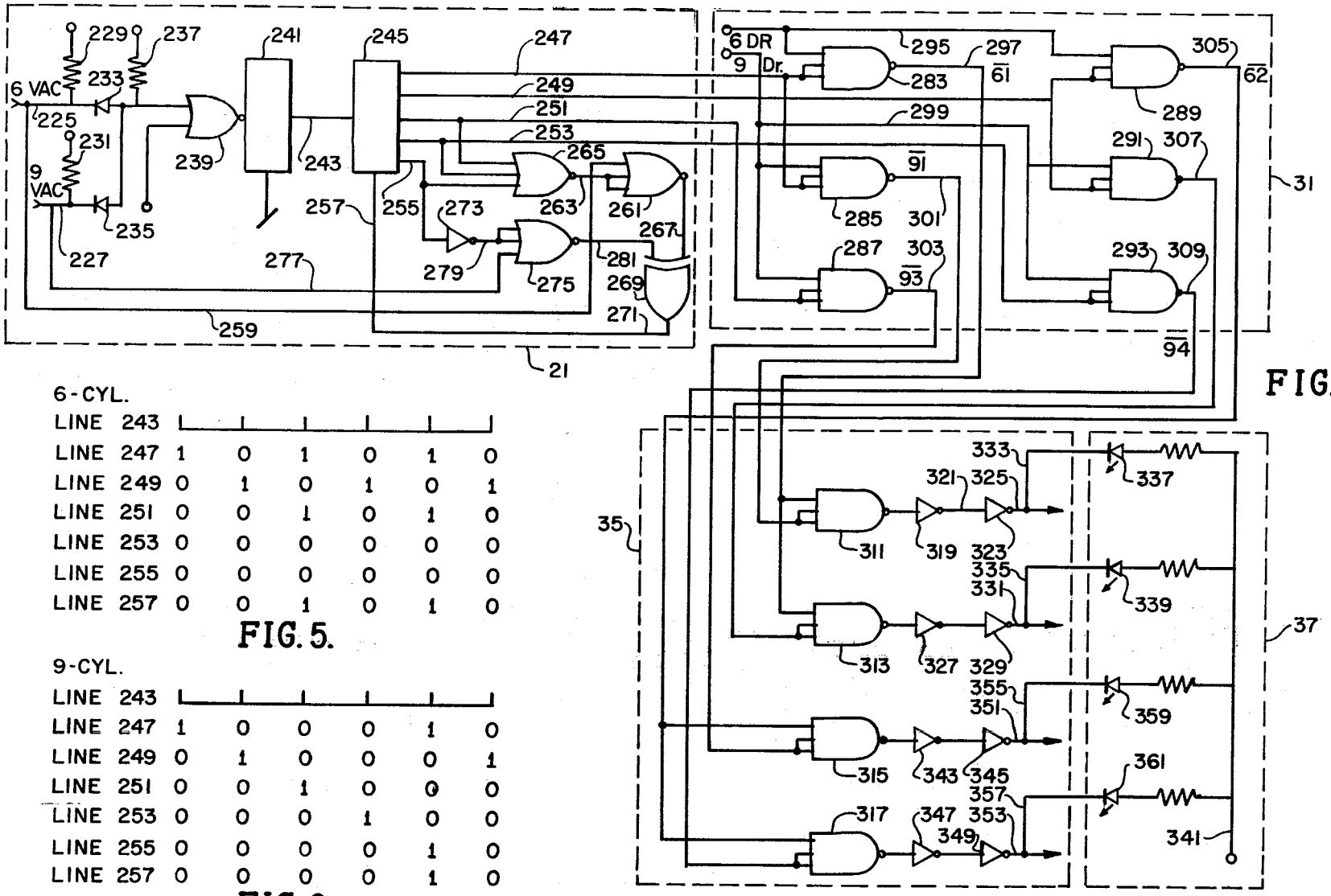
FIG. 4 is a detailed schematic illustration of the group advance circuit, group decoder circuit, driver interface circuit and group display circuit of the present invention.
FIGS. 5 and 6 are tables showing the operation of a counter incorporated in the group advance circuit of FIG. 4.

Referring now to FIG. 4, the detailed circuitry of the group advance 21, group decoder 31, driver interface 35 and group display 37 will be described. Initially, as previously stated, the group advance circuit 21 produces signals which alternate the banks of six cylinders which operate in the six cylinder mode, or, alternatively, inhibit different groups of three injectors during the nine cylinder mode, to assure that all cylinders in the engine are sequentially used as the automobile varies between the six and nine cylinder modes, even if the twelve cylinder mode is not entered. A pair of lines 225 and 227 interconnect the input of the group advance circuit 21 to the six cylinder vacuum line 83 and nine cylinder vacuum line 81, respectively, of FIG. 2. Each of the lines 225 and 227 is normally biased to a positive potential by the resistors 229 and 231, respectively. Signals grounding the lines 225 at 227, that is, reducing these lines to a binary 0 level, will be summed through the diodes 233 and 235 and biasing resistor 237 to produce a negative going pulse at the input of a NOR gate 239. This NOR gate 239, in conjunction with a pulse shaping circuit 241, produces on an output line 243 a very narrow positive going pulse coincident with the occurrence of the leading edge of a negative going pulse at the input of the gate 239. This narrow positive going pulse is applied to a counter 245 which sequentially places a binary 1 level on one of the output lines 247, 249, 251, 253, and 255, while producing a binary 0 level on all remaining output lines. Thus, in the absence of a clear signal on line 257, successive pulses on the line 243 will successively shift the binary 1 signal from the line 247 to the line 249, and then to the line 251, and so on. A clear signal on input line 257 will reset the counter 245, reinstating a binary 1 on line 247 and a binary 0 on all of the remaining output lines.

If a binary 0 exists on line 225, this signal level is conducted by way of line 259 as one input of a NOR gate 261. The other input of the NOR gate 261 is provided by an output line 263 from a NOR gate 265. This NOR gate 265, in turn, is connected to the third, fourth and fifth output lines 251, 253 and 255 of the counter 245. Thus, if all of the output lines 251, 253 and 255 from the counter 245 are at binary 0, the signal on line 263 will be a binary 1, resulting in a binary 0 output on line 267 from the NOR gate 261. As soon as any of the third, fourth and fifth output lines 251, 253 and 255 has a binary 1 signal, the output of the NOR gate 265 will assume a binary 0 state. If, in this instance, the input on line 259 is at binary 0, indicating closure of the six cylinder vacuum switch of FIG. 2, the output of NOR gate 261 on line 267 will assume a binary 1 level. This binary 1 level will be applied as an input to OR gate 269, producing a binary 1 output level on line 271 which is applied to the clear input 257 of the counter 245, resetting the counter 245. It can be seen, therefore, that in the six cylinder mode, when a binary 0 signal is present on line 259, the counter 245 will first produce an output signal on line 247. When the signal on lines 225 and 227 is switched from its binary 0 level a second successive pulse from the pulse shaping circuit 241 will advance the counter 245 to produce a binary 1 level on line 249. The next successive input change will produce a binary 1 level on line 251. This signal, however, will immediately produce a binary 0 output from the NOR gate 265, resulting in a clear signal at 257 and resetting the counter 245 to produce, instead, a signal on line 247. If, when the six cylinder mode is initially entered, any of the third, fourth and fifth lines 251, 253 and 255 is at a binary 1 level, a clear signal will immediately be produced on line 257 to reset the counter 245, producing an output signal on line 247.

Referring to FIG. 5, the operation of the counter 245 in the six cylinder operational mode, that is, when the line 259 is at ground potential, is shown. It can be seen from FIG. 5 that, as soon as line 251, the third output of the counter 245, goes to binary 1, the reset line 257 immediately goes to binary 1, resetting the counter and producing a binary 1 on line 247. The binary 1 at line 251 occurs only for a very short time, a time insufficient to cause an erroneous operation of the circuit. Once reset, the counter, again in response to the next succeeding pulses on the line 243, counts from line 247 to 249, and again to line 251, producing a reset pulse on line 257 and immediately resetting the counter 245 to produce a binary 1 output signal level only on line 247. The output of the counter 245 in the six cylinder mode therefore alternates between a signal on line 247 and a signal on line 249, a different line being energized each time the six cylinder mode is entered, as indicated by a pulse on line 243.

In the nine cylinder mode of operation, the fifth output line 255 of the counter 245 is inverted in an inverter 273 and applied as one input to a NOR gate 275. The other input to this NOR gate 275 is supplied by a line 277 connected to input line 227 from the nine cylinder vacuum switch. Thus, when nine cylinder operation is ordered, the line 277 is at binary 0. The output of the inverter 273 on line 279 will normally be a binary 1, indicating a binary 0 level on line 256, and resulting in a binary 0 level on the output line 281 of the NOR gate 275. As soon as the counter 245 applies a binary 1 signal to the line 255, this signal is inverted by the inverter 273, producing a binary 0 at the remaining input of the NOR gate 275 and generating a binary 1 signal on line 281. This signal is applied to OR gate 269 to produce a binary 1 signal at the clear line 257 of the counter 245, immediately producing a binary 1 signal on output line 247. This operation in the nine cylinder mode is diagrammed in FIG. 6. It can be seen from this figure that normal counter operation will proceed until an output signal is produced on line 255. This signal will immediately produce a clear signal on line 257 which, in turn, will produce an output signal on line 247. It will thus be understood that the binary 1 signal appears only momentarily on line 255, and for a period insufficient to alter the operation of the circuit. The output of the counter 245 in the nine cylinder mode is therefore a sequential counting of the first four lines 247-253, and a repetition of this count each time the nine cylinder mode is entered.

The group decoder 31, shown in FIG. 4, responds to the output of the counter 245 as well as the output of the six, nine and twelve cylinder command circuits 14, 15, 17 of FIG. 3 to produce signals for driving the driver interface 35. The group decoder 31 comprises six NAND gates 283 through 293, each responding to one of the output lines from the six and nine cylinder command circuits 14, 15 and one of the outputs from the counter 245. Thus, the NAND circuit 283 is connected to line 295 which is, in turn, connected to line 111 of FIG. 3, and to the first output line 247 of the counter 245. The NAND gate 283 produces an output signal on line 297 which is at binary 1 only if both the six cylinder drive line 111 and the output line 247 from counter 245 are at binary 0. The line 297 is therefore labelled $\overline{61}$. Similarly, the NAND gate 285 is connected to a drive line 299 connected to the nine cylinder drive line 137 of FIG. 3 and the first output line 247 of counter 245 and has a binary 1 signal on its output line 301 only if both of these input signals are at a bianry 0 level. The line 301 is thus labelled $\overline{91}$. Similarly, the output line 303 from NAND gate 287 is labelled $\overline{93}$ and has a binary 1 level only if both the line 137 of FIG. 3 and 251 of FIG. 4 are at binary 0. In a like manner, the output lines 305, 307 and 309 from the NAND gates 289, 291 and 293 are labelled $\overline{62}$, $\overline{92}$ and $\overline{94}$, respectively. Each of the signals on these output lines are applied to the driver interface 35 and are again combined in a series of NAND gates 311 through 317. If, for example, the operation of six cylinders is required by a signal on the six cylinder drive line 295, one of the output lines 297 and 305 will be at a binary 1 level while the other will be at a binary 0 level. If, for example, the line 297 is at a binary 0 level, this level will induce a binary 1 level at the output of the NAND gate 311. This NAND gate 311, through an inverter 319, will produce a binary 0 signal on line 321 which, in turn through the inverter 323, will produce an amplified binary 1 signal at line 325. As will be seen from the description which follows, this binary 1 signal on line 325 will operate to disable a first group of three injectors. Simultaneously, the signal on line 297 will generate a binary 1 signal on the output of NAND gate 313 which, through inverters 327 and 329, will produce an amplified binary 1 signal on line 331 for disabling a second group of three fuel injectors. The signals on lines 325 and 331 are conducted through leads 333 and 335 to a pair of light emitting diodes 337 and 339, respectively, of the group display 37. The binary 1 signal on one side of the light emitting diode will cancel and equivalent voltage potential supplied from a source at 341, so that the light emitting diode 337 and 339 will not be illuminated, indicating that their respective banks of injectors are not functioning. At the same time, the signal from line 305 will be a binary 1, which will produce a binary 0 signal from the NAND gates 315 and 317. These signals, in turn through the inverters 343, 345, 347 and 349, will produce binary 0 signals at lines 351 and 353. These binary 0 signals will not interfere with the normal operation of the last two groups of injectors. The ground potential of these lines will be conducted by leads 355 and 357 to illuminate a pair of light emitting diodes 359 and 361, a voltage potential existing between the source 341 and the leads 355 and 357, respectively.

In similar fashion, if a nine cylinder drive signal is present at line 249, one of the lines 301, 303, 307 and 309 will be at a binary 0 level, while the remaining three of these lines will be at a binary 1 level. That signal which is at a binary 0 level will drive one of the NAND gates 311 through 317 to produce a binary 1 signal on one of the output lines 325, 331, 351 and 353. The remaining three output lines will remain at binary 0. Thus, only one of the injector groups will be disabled, while three will be enabled in a normal manner, and three of the light emitting diodes 337, 339, 359 and 361 will be illuminated.

The counter circuit 245, in conjunction with the drive lines 295 and 299, therefore dictate which pair of the output lines 325, 331, 351 and 353 will have a binary 1 signal during six cylinder operation and which single one of these output lines will have a binary 1 during nine cylinder operation.

Referring now to FIG. 7, one of the multiple circuits which make up the injector driver 39, and specifically the circuit connected to drive injector group 23 of FIG. 1, will be described, it being understood that each of the injector groups 25, 27 and 29 of FIG. 1 is driven by an identical injector driver circuit, connected to a different one of the output lines 325, 331, 351 and 353 of FIG. 4.

When a binary 1 signal is present at line 325 of FIG. 4 it is applied at input line 363 of FIG. 7. Current from this signal flows into the base of a switching transistor 365, causing it to turn on, and permitting current to flow through a relay coil 367 and a light emitting diode 369. The light emitting diode 369 is used to show energization of the relay coil 367. The relay coil 367 operates three normally closed switches 371, 373 and 375 which interconnect the injector computer 377 to the injectors 379, 381, 383. The computer 377 is a standard part in the automobile, and is used for operating the individual fuel injectors at the proper time and for the proper time duration. Operation of the relay coil 367 therefore inhibits operation of the injector group 23, including injectors 379-383, so that, if all of the remaining injector groups are operating, only nine cylinders of the automobile will function. The injectors are grouped so that the engine will run in a balanced manner with all possible six and nine cylinder modes. It can be seen from the circuit of FIG. 4 that there are never more than two relays energized at one time. None of the relays is energized for twelve cylinder operation, since, in this condition, as shown in FIG. 4, none of the outputs from the NAND gates 283, 285, 287, 289, 291 and 293 is at a binary 1 level.

From the preceding explanation and description, it can be seen that the circuit of the present invention will operate a twelve cylinder engine in any of three modes, six, nine and twelve cylinders, and will rotate the cylinder banks which are operated in the partial modes, that is, the six and nine cylinder modes. Under normal operation, without intervention of the manual switching, the vacuum switch 77 will operate the engine in the six cylinder mode under low load or powder demand conditions, in the nine cylinder mode for moderate loads and in the twelve cylinder mode for maximum loads, such as during acceleration or steep hill climbing. If the operator closes the SKIP 6 switch on the dashboard, the engine will operate in the nine cylinder mode during low and moderate loads and the twelve cylinder mode during heavy engine loads. If, on the other hand, the operator closes the SKIP 9 switch at the driver station, the engine will operate in the six cylinder mode for low engine loads and in the twelve cylinder mode for moderate and high engine loads.

By use of the manual switches 43, 45, 47, the operator can override the automatic vacuum control and require that the engine operate in either the six, nine or twelve cylinder modes at all times. During cycling of the engine system from one mode to another, the group advance circuit 21 assures that different banks of six cylinders will operate on each successive entering of the six cylinder mode and that different groups of three cylinders will be deactivated as the nine cylinder mode is successively entered, thus assuring uniform engine wear and cooling.

The light emitting diodes which have been described in reference to the circuit assure that the driver will be aware at all times of the mode in which the engine is operating and the particular banks of cylinders which have been deactivated.

What is claimed is:

1. A circuit for selectively interrupting electrical signals from a fuel injection control circuit to multiple fuel injectors in a multiple cylinder automobile engine, comprising:

means for sensing the load on said engine, said means producing at least three output signals indicative of at least three different load levels on said engine;

circuit means responsive to said output signals for interrupting the electrical signals from said fuel injection control circuit to said multiple fuel injectors, said means interrupting a first number of said signals in response to a first one of said output signals and interrupting a second number of said signals in response to a second one of said output signals, said circuit means interrupting none of said signals in response to a third one of said output signals; and means connected to said sensing means and said circuit means for changing the specific fuel injection control circuit signals interrupted in said first and second numbers of said signals each time that said first one or said second one of said output signals is initiated.

2. A circuit for selectively interrupting electrical signals as defined in claim 1 wherein said means for changing comprises a counter connected to count output signals from said sensing means and connected to control the operation of said circuit means.

3. A circuit for selectively interrupting electrical signals as defined in claim 1 additionally comprising:

first manual switch means for overriding said sensing means and directly controlling said circuit means.

4. A circuit for selectively interrupting electrical signals as defined in claim 3 wherein said first manual switch means produces signals equivalent to said three output signals from said sensing means, said equivalent signals directly driving said circuit means.

5. A circuit for selectively interrupting electrical signals as defined in claim 4 wherein said first manual switch means deactivates said sensing means.

6. A circuit for selectively interrupting electrical signals as defined in claim 1 additionally comprising:

indicator means for notifying an operator as to which of said first number of said signals and said second number of said signals is being interrupted by said circuit means.

7. A circuit for selectively interrupting electrical signals as defined in claim 1 wherein said circuit means controls the operation of said fuel injectors in groups, each group including an equal fraction of the total number of said injectors.

8. A circuit for selectively interrupting electrical signals as defined in claim 1 wherein said circuit means comprises:

switching transistors operated in response to said three output signals from said sensing means; and relays having contacts interposed between said fuel injection control circuit and said multiple fuel injectors, said relays operating in response to said switching transistors.

9. A circuit for selectively interrupting electrical signals from a fuel injection control circuit to multiple fuel injectors in a multiple cylinder automobile engine, comprising:

means for sensing the load on said engine, said means producing at least three output signals indicative of at least three different load levels on said engine;

circuit means responsive to said output signals for interrupting the electrical signals from said fuel injection control circuit to said multiple fuel injectors, said means interrupting a first number of said signals in response to a first one of said output signals and interrupting a second number of said signals in response to a second one of said output signals; and manual switch means connected to said circuit means for rendering said circuit means not responsive to one of said at least three output signals from said sensing means to thereby delete from circuit operation the interruption of either said first number of said signals or said second number of said signals.

10. A circuit for selectively interrupting electrical signals as defined in claim 9 wherein said manual switch means controls said circuit means to substitute a different number of said electrical signals from said fuel injection control circuit to said multiple fuel injectors for the number of signals deleted by said switch means.

11. A circuit for selectively disconnecting multiple leads connecting a fuel injection driver circuit of an engine to multiple fuel injectors for multiple cylinders, comprising:

plural switching means, each for selectively disconnecting at least one of said multiple leads;

means sensing the load of said engine, said means producing output signals indicative thereof;

means responsive to said output signals from said sensing means for automatically opening at least three different groups of said plural switching means, two of said three different groups including an equal number of said plural switching means; and means for automatically changing the switching means included in each of said at least two different groups of said switching means in response to the initiation of said output signals from said sensing means.

12. A circuit for selectively disconnecting multiple leads as defined in claim 11 wherein said means for automatically changing comprises an electronic counter connected to count the initiation of signals from said sensing means and connected to control said means for automatically opening said switching means.

13. A circuit for selectively disconnecting multiple leads as defined in claim 12 wherein said electronic counter has at least two different counting modes, said modes depending on which of said different groups of said plural switching means is opened by said means for opening.

14. A circuit for selectively disconnecting multiple leads as defined in claim 11 additionally comprising:

manual switching means for overriding said sensing means and permitting manual control of said means for automatically opening.

15. A circuit for selectively disconnecting multiple leads as defined in claim 11 additionally comprising:

manual switching means for permitting manual control to prohibit said automatically opening means from opening one of said three different groups of said plural switching means.

16. A circuit for selectively disconnecting multiple leads as defined in claim 11 wherein said sensing means comprises:

a vacuum operated switch connected to the intake manifold of said engine and producing at least three different output signals indicating different load levels of said engine.

17. A circuit for selectively inhibiting operation of fuel injectors in a multiple cylinder internal combustion engine in response to engine load by selectively disconnecting individual injectors from an injector control circuit, comprising:

a vacuum switch assembly connected to the intake manifold of said engine and producing at least three different output signals in response to three different vacuum levels within said manifold;

at least three command circuits each connected to respond to one of said three different output signals of said vacuum switch assembly, and each producing a driving signal for inhibiting operation of a different number of said fuel injectors, the larger of said different numbers of said fuel injectors not including all of the injectors of the smaller of said different numbers of said fuel injectors; and switching means responsive to said driving signals for disconnecting said injectors from said injector control circuit.

18. A circuit for selectively inhibiting operation of fuel injectors in a multiple cylinder internal combustion engine in response to engine load by selectively disconnecting individual injectors from an injector control circuit, comprising:

a vacuum switch assembly connected to the intake manifold of said engine and producing at least three different output signals in response to three different vacuum levels within said manifold;

at least three command circuits each connected to respond to one of said three different output signals of said vacuum switch assembly, and each producing a driving signal for inhibiting operation of a different number of said fuel injectors;

switching means responsive to said driving signals for disconnecting said injectors from said injector control circuit; and a group decoder circuit connected to said command circuits for responding to said driving signals to produce injector output signals.

19. A circuit for selectively inhibiting operation of fuel injectors as defined in claim 18 additionally comprising:

a group advance circuit connected to said vacuum switch assembly and said group decoder circuit for selectively altering the individual injectors to be driven by each of said driving signals, said group decoder circuit producing injector drive signals in response to the signals of said group advance circuit and said command circuits.

20. A circuit for selectively inhibiting operation of fuel injectors as defined in claim 19 wherein said group advance circuit comprises an electronic counter responsive to signals from said vacuum switch assembly for producing plural sequential output signals.

21. A circuit for selectively inhibiting operation of fuel injectors as defined in claim 20 wherein said counter circuit operates in at least two different operational modes, said modes determined by said driving signals.

* * * * *